US008292127B2

(12) United States Patent
van der Heijden

(10) Patent No.: US 8,292,127 B2
(45) Date of Patent: Oct. 23, 2012

(54) SELF-CLEANING FOAM-DISPENSING DEVICE

(75) Inventor: Edgar Ivo Maria van der Heijden, Broek Op Langedijk (NL)

(73) Assignee: Rexam Airspray N.V., Alkmaar (NL)

( * ) Notice: Subject to any disclaimer, the term of this patent is extended or adjusted under 35 U.S.C. 154(b) by 1059 days.

(21) Appl. No.: 12/162,815

(22) PCT Filed: Feb. 6, 2007

(86) PCT No.: PCT/NL2007/000035

§ 371 (c)(1),
(2), (4) Date: Jul. 31, 2008

(87) PCT Pub. No.: WO2007/091882

PCT Pub. Date: Aug. 16, 2007

(65) Prior Publication Data

US 2009/0020552 A1 Jan. 22, 2009

(30) Foreign Application Priority Data

Feb. 7, 2006 (NL) ..... 1031092

(51) Int. Cl.
*B67D 7/46* (2010.01)

(52) U.S. Cl. ..... 222/190; 222/137; 222/383.1; 239/112; 239/333

(58) Field of Classification Search ..... 222/149, 222/181.1, 181.3, 190, 383.1, 135, 137; 239/106, 239/112, 333

See application file for complete search history.

(56) References Cited

U.S. PATENT DOCUMENTS

| | | | | |
|---|---|---|---|---|
| 5,110,052 | A * | 5/1992 | Graf et al. | 239/333 |
| 5,271,530 | A * | 12/1993 | Uehira et al. | 222/190 |
| 5,443,185 | A * | 8/1995 | Fuchs | 222/321.8 |
| 5,443,569 | A * | 8/1995 | Uehira et al. | 222/190 |
| 5,570,840 | A * | 11/1996 | Gettinger et al. | 239/112 |
| 7,004,356 | B1 * | 2/2006 | Sayers | 222/137 |
| 2005/0017025 | A1 * | 1/2005 | Niada | 222/190 |

FOREIGN PATENT DOCUMENTS

DE 19618318 11/1996

(Continued)

OTHER PUBLICATIONS

Japanese Office Action, with translation, for Japanese Patent Application, No. 2008-553189, issued May 30, 2012.
English machine translation of JP 09-193953.

(Continued)

*Primary Examiner* — Kevin P Shaver
*Assistant Examiner* — Andrew P Bainbridge
(74) *Attorney, Agent, or Firm* — Hoffmann & Baron, LLP

(57) ABSTRACT

A foam dispensing device uses a single actuator to actuate two concentric pistons, one for an air chamber and one for a telescopically oriented liquid chamber. In all of the various embodiments the liquid chamber stops its actuation first and can continue to move along with the single actuator and the air chamber continues to dispense air. The air and liquids are dispensed into foaming chamber and then dispensed. The liquid chamber can continue to move because the liquid chamber is attached to the pump system by a deformable connector or some form. This arrangement allows for a foaming device that uses just one actuator that has the ability to dispense foam in the first phase and just air to clear out the nozzle effectively in the second phase.

11 Claims, 17 Drawing Sheets

FOREIGN PATENT DOCUMENTS

| | | | |
|---|---|---|---|
| JP | 07-300150 | A | 11/1995 |
| JP | 09-193953 | A | 7/1997 |
| JP | 2006-150289 | A | 6/2006 |
| WO | 01/81004 | A1 | 11/2001 |

OTHER PUBLICATIONS

English machine translation of JP 07-300150.

English machine translation of JP 2006-150289.

* cited by examiner

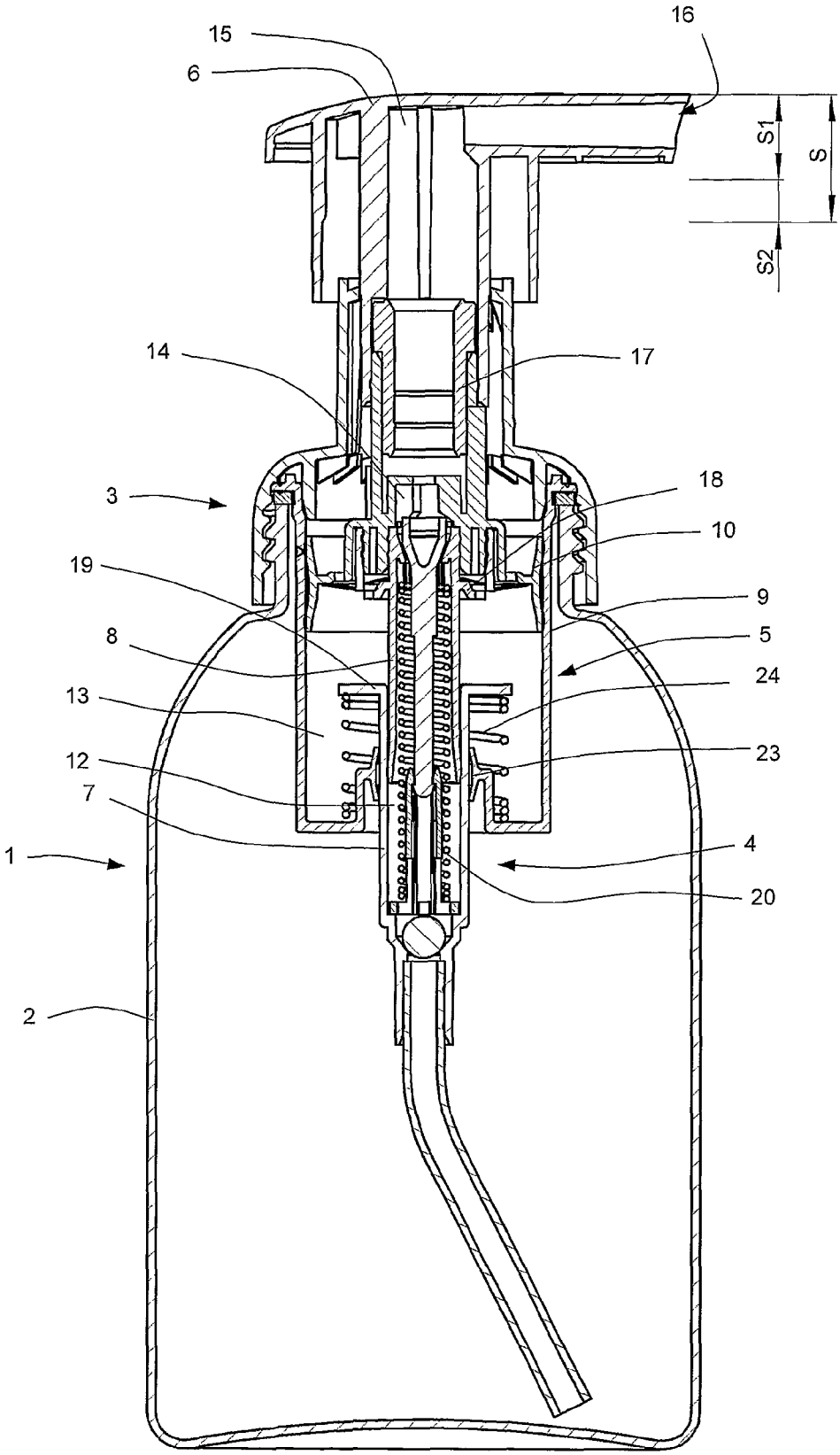
Figuur 3a

SELF-CLEANING FOAM-DISPENSING DEVICE

CROSS-REFERENCE TO RELATED APPLICATIONS

This application is the National Stage of International Application No. PCT/NL2007/000035, filed Feb. 6, 2007, which claims the benefit of Netherlands Application No. NL 1031092, filed Feb. 7, 2006, the contents of which is incorporated by reference herein.

FIELD OF THE INVENTION

The present invention relates to a dispensing device for dispensing a foam. More particularly, the invention relates to a manually operable dispensing device for dispensing a foam, which comprises a liquid pump and an air pump for pumping a foamable liquid and air, respectively.

BACKGROUND OF THE INVENTION

Dispensing devices for dispensing a foam are known per se. U.S. Pat. No. 5,271,530 and U.S. Pat. No. 5,443,569, for example, disclose a dispensing device which comprises a pump assembly for forming a foam. The pump assembly comprises a liquid pump for pumping liquid and an air pump for pumping air to a common dispensing passage. The liquid pump and air pump can be actuated simultaneously by pressing a common operating button, the pumped liquid and air being mixed in a mixing chamber provided in the dispensing passage to form a foam, which foam is subsequently guided through a sieve element having two sieves for homogenizing and smoothing the foam. The formed foam is dispensed via a dispensing opening which is arranged in the common operating button.

The known dispensing device has proved to be very successful for forming and dispensing a foam with a large number of different applications, such as soap, shampoo, suntan lotion, dishwashing liquid, shaving foam, skin-care products and the like.

A drawback of the known dispensing device is that after the foam has been formed and dispensed by the operating element being pressed, a certain amount of foam remains behind in the dispensing passage. This foam will, possibly after it has become a liquid again, dry up.

Depending on the application for which the dispensing device is used and the liquid which is required for this purpose, this dried-up liquid will more or less become encrusted in the dispensing passage. This may be particularly disadvantageous with the sieves in the sieve element, since the dried-up and encrusted liquid may block the sieves and thus render it more difficult to subsequently dispense foam using the dispensing device or may even prevent it.

Another disadvantage of the known dispensing device is that the foam which remains behind in the dispensing passage, for example near the dispensing opening, can drip from the dispensing opening, in particular when the foam turns back into a liquid again. It is possible that this dripping occurs in particular when the dispensing device is moved or stored in a non-vertical position. This problem also occurs with dispensing devices which have been positioned or are operated in such a manner that the dispensing opening is at least partly pointing downwards, for example in a wall dispensing device which is arranged in a fixed position on the wall with the dispensing opening pointing downwards, such as are in use in public toilets. Such dripping is undesirable, in particular as it is possible that this dripping only occurs some time after the dispensing device has been used, that is when the foam has turned back into liquid.

It is known per se to allow the air, which is sucked into the air pump during the return stroke of the operating element for a new stroke, to flow through the dispensing passage so that this air sucks the foam back out of the dispensing passage and in particular out of the sieves. However, the foam is carried along into the air pump chamber and may there adversely affect the action of the air pump, as has been described above. Although such foam pumps are referred to as being self-cleaning, they do not achieve the desired result. The foam which remains behind in the dispensing passage is sucked back into the dispensing device, but may there turn into a liquid and still flow out of the dispensing opening.

In addition, the sucked-back foam and/or the liquid formed from it may dry up in the dispensing device and become encrusted and thus negatively affect the action of the dispensing device. In particular, in the known dispensing device, the foam/the liquid may end up on the air piston or in the air chamber of the air pump. Liquid which has dried up and become encrusted there may in particular reduce the guidance between the air cylinder and the air piston and thus the action of the air pump.

SUMMARY OF THE INVENTION

It is an object of the invention to provide a dispensing device for forming a foam which reduces the quantity of foam remaining behind in the dispensing passage, in particular in the mixing chamber and/or the sieve elements.

This object is achieved by means of a dispensing device comprising a pump assembly, which pump assembly comprises a liquid pump and an air pump, which can be actuated by means of a common operating element, which can be moved with respect to a fixed part of the pump assembly, for delivering a liquid and air, respectively, to a common dispensing passage where the liquid and the air are combined to form a foam, the operating element being able to perform a stroke in order to actuate the liquid pump and the air pump, which is characterized in that the foam-dispensing device is designed to deliver, during a first part of the stroke, both liquid from the liquid pump and air from the air pump to the dispensing passage in order to form a foam, and to deliver, during a second part of the stroke, only air from the air pump to the dispensing passage.

This air which will be dispensed during the second part of the stroke will push/blow the foam which is already present in the dispensing passage forward in the direction of the dispensing opening. As a result, less foam will remain behind in the dispensing passage and thus less foam/liquid will dry up in this dispensing passage.

In general, there are three different possible ways of dividing the stroke of the common operating element into a first part, in which both pumps are being actuated, and a second part in which only the air pump pumps air to the dispensing passage.

A first possibility is to make the liquid pump move completely concomitantly during the second part of the stroke. By coupling the entire liquid pump to the operating element at the end of the first part of the stroke of the operating element, the entire liquid pump will move concomitantly during the second part of the stroke of the operating element. By making the entire liquid pump move concomitantly with the operating element, the liquid pump will not pump any liquid anymore.

In one embodiment, making the liquid pump move concomitantly is possible by movably connecting it to a part of the pump assembly which is fixedly connected to the container in the direction of operation of the operating element, for example by means of a flexible connection or by means of a spring element, such as a spring or bellows.

A second possibility to prevent the delivery of liquid to the dispensing passage during the second part of the stroke of the operating element is to return the liquid pumped during the second part of the stroke to the container instead of to the dispensing passage, for example by closing the liquid delivery valve to the dispensing passage and opening a second liquid delivery valve which allows the liquid to flow back to the container. The second liquid delivery valve may, for example, be a pressure relief valve which opens as soon as the pumping of liquid further towards the dispensing opening is prevented at the end of the first part of the stroke of the operating element, as a result of which the pressure in the pump chamber of the liquid pump increases.

A third possibility is uncoupling the connection between the operating element and the liquid pump. With the known dispensing device, a movable part of the liquid pump, in particular the liquid piston, is directly and rigidly connected to the operating element. By designing the operating element and a movable part of the liquid pump in such a manner that they can be uncoupled from one another or that they are connected to one another in a flexible or resilient manner, it is possible to achieve that the liquid pump no longer operates during the second part of the stroke of the operating element and, as a result thereof, no longer dispenses liquid. Consequently, only the air pump pumps air to the dispensing passage.

In one embodiment according to the first or third possibility, use is made of cam elements on a first pump part and a second pump part of the liquid pump, which first part and second part can be moved with respect to one another during the first part of the stroke, with the cam elements bearing against one another at the end of the first part of the stroke, so that the first pump part and the second pump part are coupled to one another and cannot move with respect to one another during the second part of the stroke.

BRIEF DESCRIPTION OF THE DRAWING

A detailed description of various embodiments of a dispensing device according to the invention will be given below, in which further advantages and features of a dispensing device according to the invention will be explained in more detail. In this connection, reference will be made to the attached figures, in which:

FIGS. 3*a*-3*c* show a third embodiment of a dispensing device according to the invention;

DETAILED DESCRIPTION OF PREFERRED EMBODIMENTS

Figure 1A:
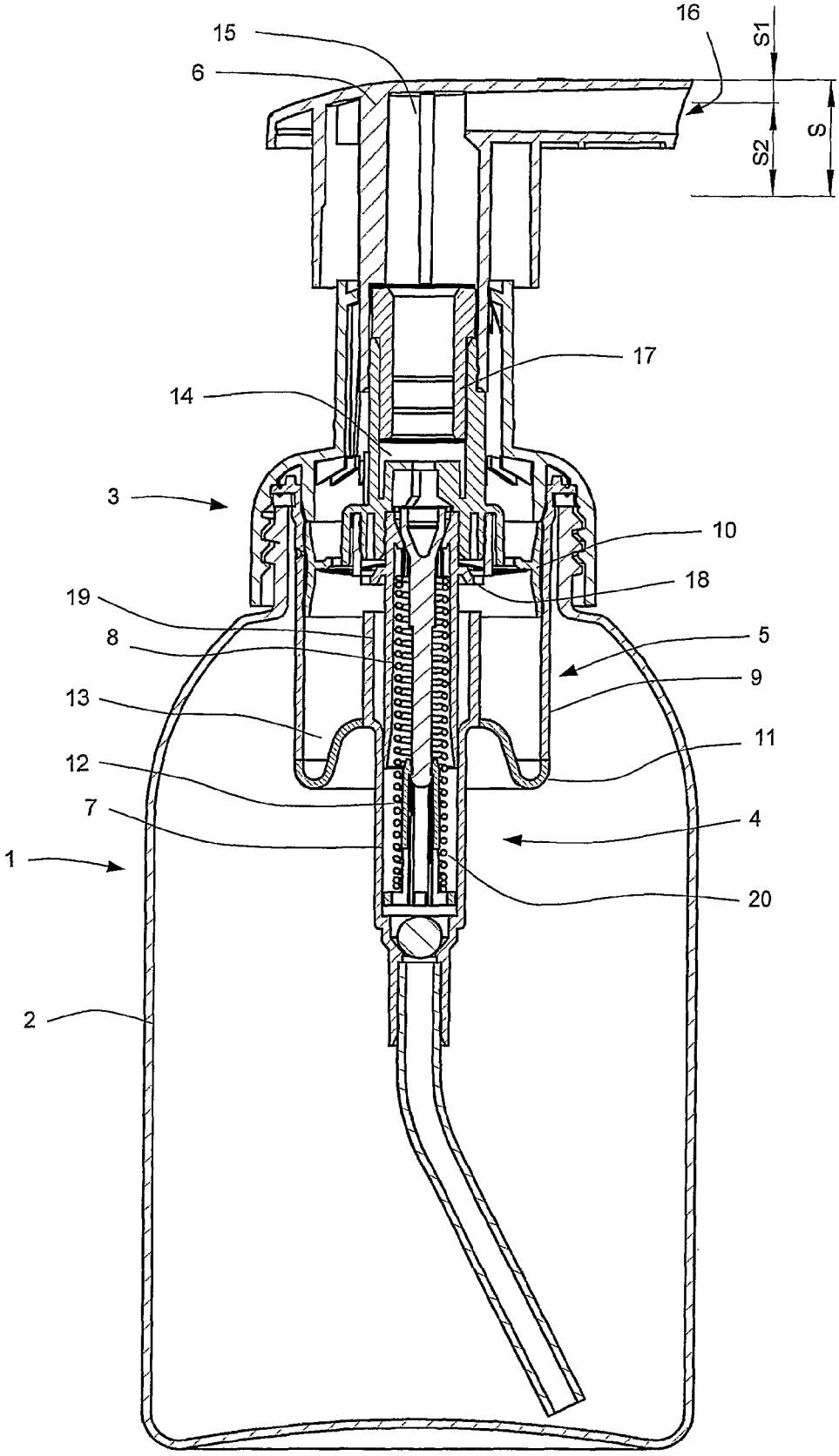
FIGS. 1*a*-1*c* show a first embodiment of a dispensing device according to the invention.

FIG. 1*a* shows a dispensing device for dispensing a foam which is denoted overall by reference numeral 1. The dispensing device comprises a container 2 for holding a foamable liquid. The illustrated container 2 is a bottle which has to be aerated in order to prevent it from collapsing due to an underpressure in the container. However, it is also possible to use compressible containers, such as air-tight bags or compressible bottles.

A pump assembly 3 is fitted on an opening of the container 2. The pump assembly comprises a fitting collar for fitting the pump assembly 3 to the container 2, a liquid pump 4, an air pump 5 and a common operating button 6 which serves as operating element for the liquid pump and the air pump. In an alternative embodiment, the operating element may also be designed as a lever of a so-called trigger pump or a button of a wall-mounted container. The common operating button 6 can perform a stroke S with respect to a fixed part of the pump assembly 3.

In the context of this application, stroke is intended to mean the path which the operating button 6 travels from its rest position to the position in which the operating button 6 is pushed in as far as possible (stroke S in FIG. 1*a*). In the present application, this stroke is subdivided into a first part S1 of the stroke and a second part S2 of the stroke. The first part of the stroke denotes the path which is initially traveled by the operating button 6, when it is moved out of its rest position and the second part of the stroke is the path which is traveled by the operating button 6 at the end of the stroke after the first part of the stroke has finished. In the embodiment shown in FIG. 1*a*, the rest position is the highest position of the operating button 6, while the end of the stroke is reached when the operating button 6 is in the position where it is pushed in as far as possible (distance S downwards).

The liquid pump 4 comprises a liquid cylinder 7 and a liquid piston 8. The air pump 5 comprises an air cylinder 9 and an air piston 10. The liquid cylinder 7 and the air cylinder 9 are built as one component, a so-called double cylinder, in which the element 11 which connects the liquid cylinder 7 and the air cylinder 9 to one another is made of a flexible, preferably elastic, material. Such a double cylinder with a relatively flexible element 11 which connects the liquid cylinder 7 and the air cylinder 9 to one another can, for example, be produced by two-component injection-moulding. It is also possible to produce the liquid cylinder 7 and the air cylinder 9 separately first and then connect them to one another by means of the flexible part 11.

If the operating button 6 is pushed in by a user, the liquid piston 8 and the air piston 10 will move downwards, together with the operating button 6. During the first part of the stroke of the operating button 6, both the liquid cylinder 7 and the air cylinder 9 will remain in their respective positions. As a result, the space in pump chamber 12 of the liquid pump 4 and the space in pump chamber 13 of the air pump 5 will become smaller and liquid and air will by dispensed to a mixing chamber 14 by the liquid pump 4 and the air pump 5, respectively. In this mixing chamber 14, first a foam is formed which is dispensed by a dispensing passage 15, which runs substantially through the operating button 6, at a dispensing opening 16. In the dispensing passage 15, the foam flows through two sieves of a sieve element 17 in order to smooth and homogenize the foam. The action of the foam-dispensing device during the first part of the stroke is generally known per se. For a description of further details of this known action for forming foam, reference is made, for example, to U.S. Pat. No. 5,271,530 and U.S. Pat. No. 5,443,569, which documents are hereby incorporated in this application by way of reference.

Figure 1B:
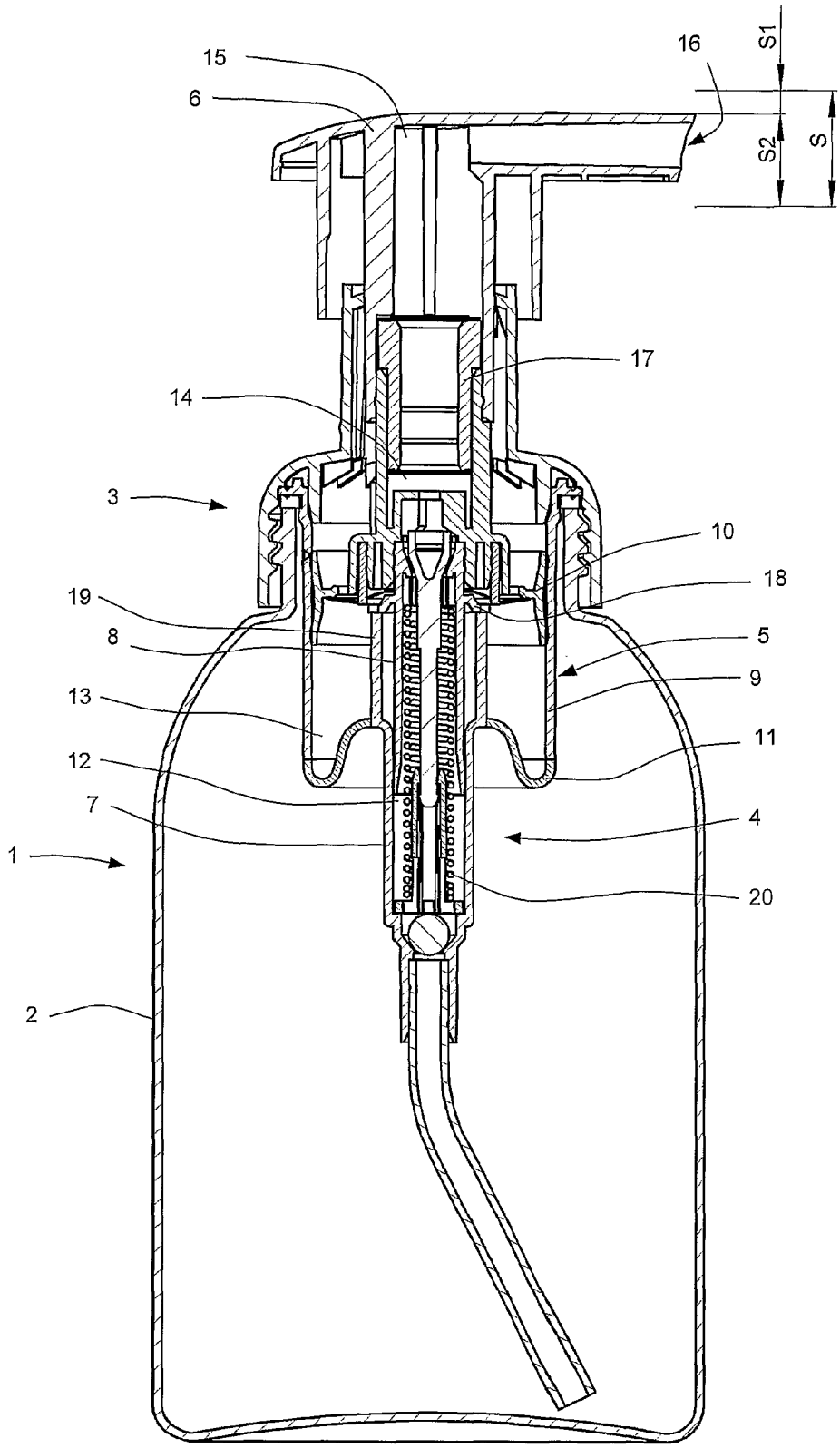

At the end of the first part of the stroke of the operating button 6, a cam element 18 arranged on the liquid piston 8 will bear against a complementary cam element 19 which is arranged on the liquid cylinder 7. This position of the operating button 6, in which the cam element 18 bears against the complementary cam element 19, is shown in FIG. 1*b*. As the cam elements 18 and 19 rest against one another, the liquid piston 8 will not be able to move further into the liquid cylinder 7 when the operating button 6 is pushed in further.

Figure 1C:
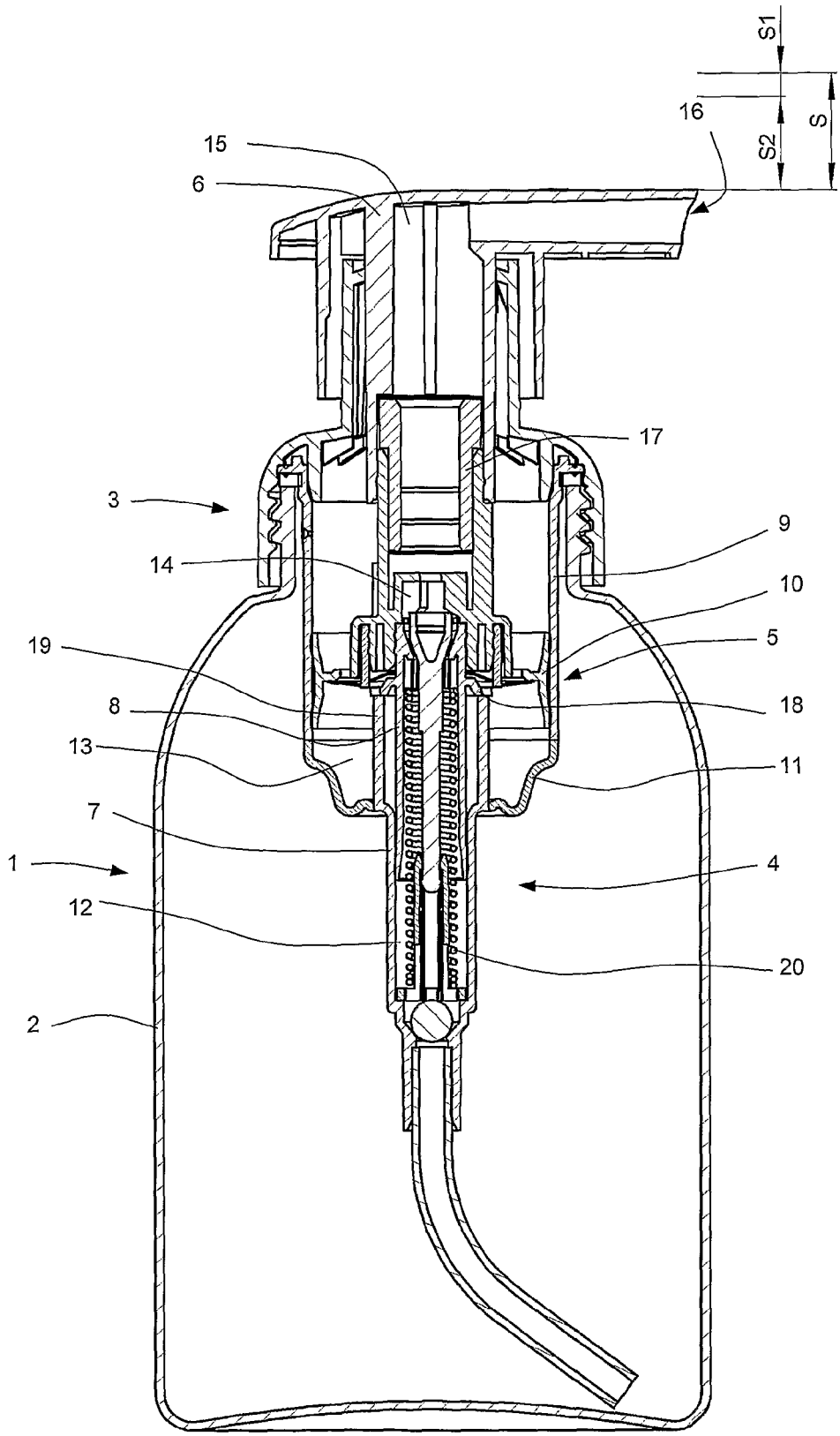

Consequently, when the operating button 6 is pushed in further, that is to say during the second part of the stroke, the liquid cylinder 7 will move concomitantly with the operating button 6 (and the liquid piston 8 and the air piston 10). The space in the pump chamber 12 will therefore not become smaller during the second part of the stroke, as a result of which no liquid will be delivered to the mixing chamber 14 during this second part of the stroke. The liquid cylinder 7 is able to move concomitantly with the operating button 6 during the second part of the stroke, during which the entire liquid pump 4 thus moves concomitantly with the operating button 6, because the liquid cylinder 7 with the flexible element 11 is connected to the fixed part of the pump assembly 3, in particular the air cylinder 9. During the second part of the stroke of the operating button 6, the flexible element 11 will thus deform in order to make it possible for the liquid cylinder 7 to move downwards. FIG. 1*c* shows the dispensing device at the end of the entire stroke. It can clearly be seen that the liquid cylinder 7 has been moved downwards relative to the air cylinder 9, the flexible element 11 having been deformed in order to make it possible for the liquid cylinder 7 to carry out this relative displacement with respect to the air cylinder 9.

The air cylinder 9 will not move concomitantly with the operating button during the second part of the stroke. The space in the pump chamber 13 of the air pump 5 will decrease during the second part of the stroke and air will be delivered to the mixing chamber, which air will be blown through the dispensing passage 15 in the direction of the dispensing opening 16. This air will move the foam which is still present in the dispensing passage 15 towards the dispensing opening 16, as a result of which at least a part of the dispensing passage 15 is free from foam. The foam removed from the dispensing passage 15 in this manner will therefore no longer be able to dry up in the dispensing passage 15 and thus adversely affect the action of the dispensing device.

Advantageously, the air which is pumped by the air pump 5 during the second part of the stroke is used to clean the sieves of the sieve element 17 by blowing, as in particular the drying up of the foam in these sieves can have a disadvantageous effect on the action of the dispensing device.

In order to ensure that the liquid cylinder 7 remains in its position during the first part of the stroke, the force which is required to deform the flexible element 11 is greater than the frictional force between the liquid cylinder 7 and the liquid piston 8.

The ratio between the forces which are required to deform the flexible element 11 are in particular determined by the shape of the flexible element 11 and the material from which it is made.

It should furthermore be noted that the space in the air pump chamber at the bottom will increase in relative terms as a result of the deformation of the flexible element 11. This results in only a part of the volume by which the air cylinder 9 is reduced as a result of the air piston 10 being moved downwards being in fact pumped as air. By effecting the deformation, in particular on the inside, i.e. near the longitudinal centre line of the dispensing device 1, this effect of the volume of the air pump chamber 13 increasing in relative terms as a result of the deformation of the flexible element 11 has been kept relatively small.

Upon its release, the operating button 6 will, together with the other components which have been moved downwards, in particular the liquid cylinder 7, liquid piston 8 and air piston 10, return to its original position as a result of the spring force of the spring 20, with the flexible element 11 returning to its original position. During this return movement, the pump chamber 12 of the liquid pump and the pump chamber 13 of the air pump will fill again with liquid and air, respectively, so that, when the operating button 6 is pushed in again, foam is formed and dispensed during a first part of the stroke, and air is blown through the dispensing passage 15 during a second part of the stroke in order to clean the latter.

In the embodiment according to FIGS. 1*a*-1*c*, the first part S1 of the stroke is significantly smaller than the second part S2 of the stroke. In particular, the first part of the stroke is approximately 20 percent and the second part of the stroke approximately 80 percent of the total stroke of the operating button 6. During operation of the dispensing device 1, relatively little foam will be formed during the first part of the stroke, while a relatively large amount of air will be blown through the dispensing passage 15 during the second part of the stroke. Such an embodiment is particularly advantageous when liquids are turned into foam, which liquids may have a considerable disadvantageous effect on the action of the dispensing device when they dry up in the dispensing passage 15, in particular in the sieves of the sieve element 17, as a relatively large amount of air is blown through the dispensing passage 15 after the foam has been formed in order to clean the dispensing passage 15.

Figure 2:
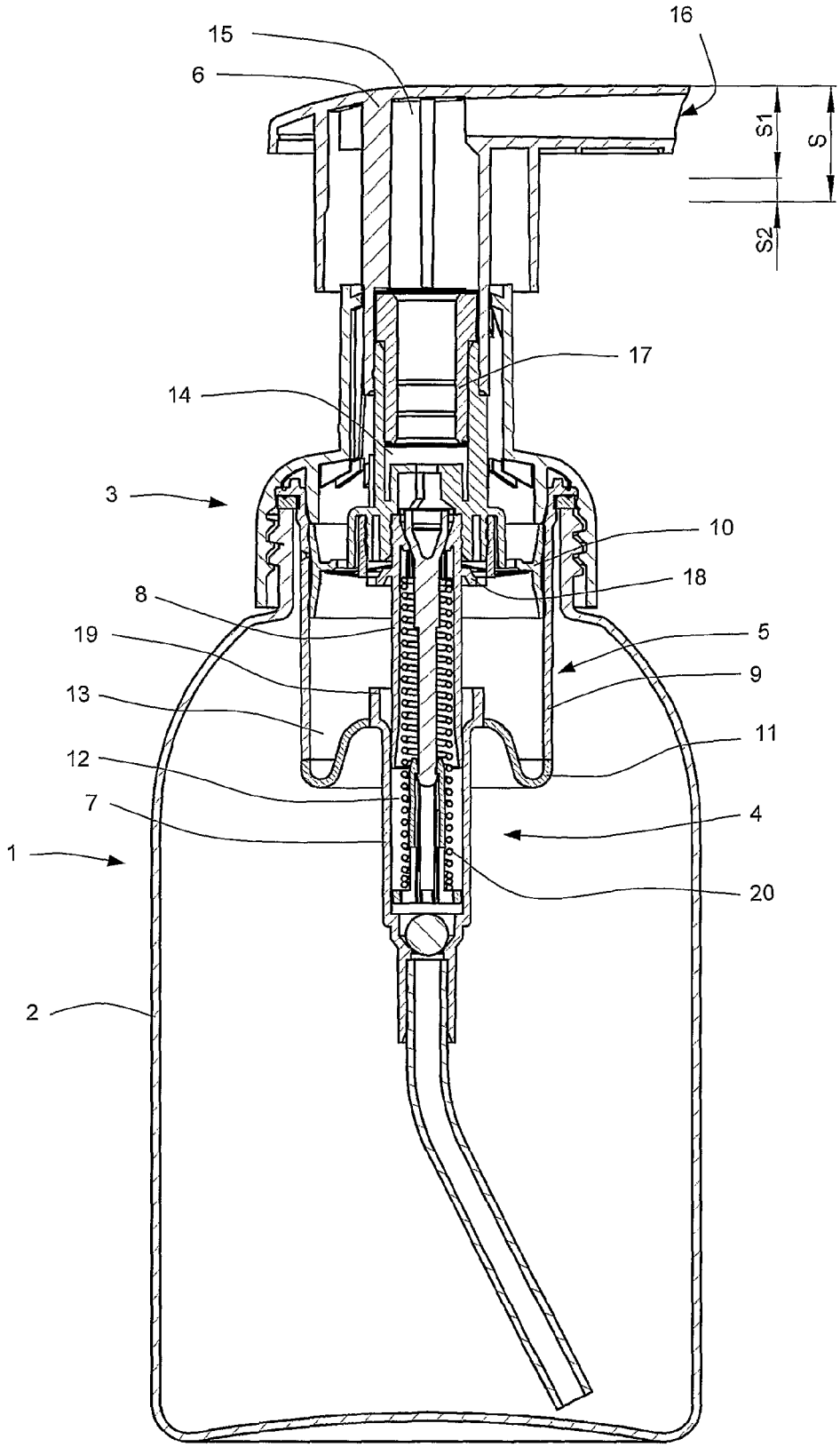
FIG. 2 shows a second embodiment of a dispensing device according to the invention.

By contrast, the embodiment according to FIG. 2 shows an embodiment in which the first part S1 of the stroke is greater than the second part S2 of the stroke. In particular, in this embodiment, the first part of the stroke is approximately 80 percent and the second part of the stroke approximately 20 percent of the total stroke S of the operating button. In the embodiment according to FIG. 2, this is achieved by providing the cam element 19 of the liquid cylinder 7 at a location which is lower than the cam element 19 in the embodiment according to FIGS. 1*a*-1*c*. As a result, the distance between the cam elements 18 and 19 is relatively great in the rest position of the dispensing device according to FIG. 2, as a result of which the distance which has to be bridged during the first part of the stroke of the operating button 6 is likewise relatively great, while the second part of the stroke is correspondingly smaller.

A relatively large amount of foam will therefore be formed during the first part of the stroke upon actuation of this embodiment of the dispensing device, while subsequently, during the second part of the stroke, relatively little air is blown through the dispensing passage 15 in order to clean the latter. Such an embodiment may be particularly advantageous in the case of liquids which, when they dry up in the dispensing passage 15, have a relatively small disadvantageous effect on the action of the dispensing device and/or which can be blown out of the dispensing passage 15 in a simple and quick manner using a relatively small amount of air.

It will be clear to the person skilled in the art that the choice of the ratio between the length of the first part of the stroke and the second part will depend on the application for which the dispensing device is used. In general, it holds true that the more important and/or difficult it is to blow the foam out of the dispensing passage, the greater the second part of the stroke will have to be.

Figure 3B:
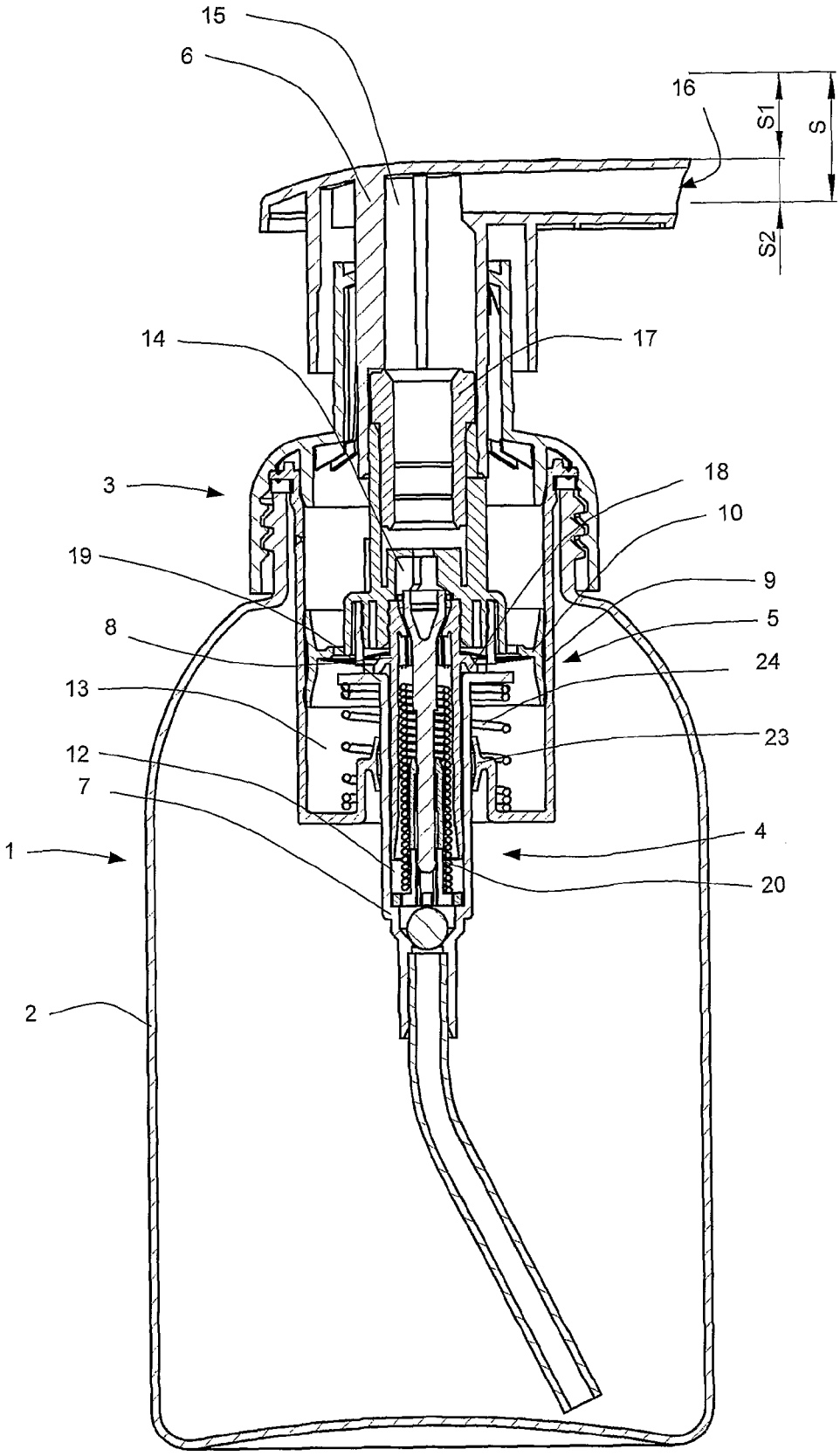
Figure 3C:
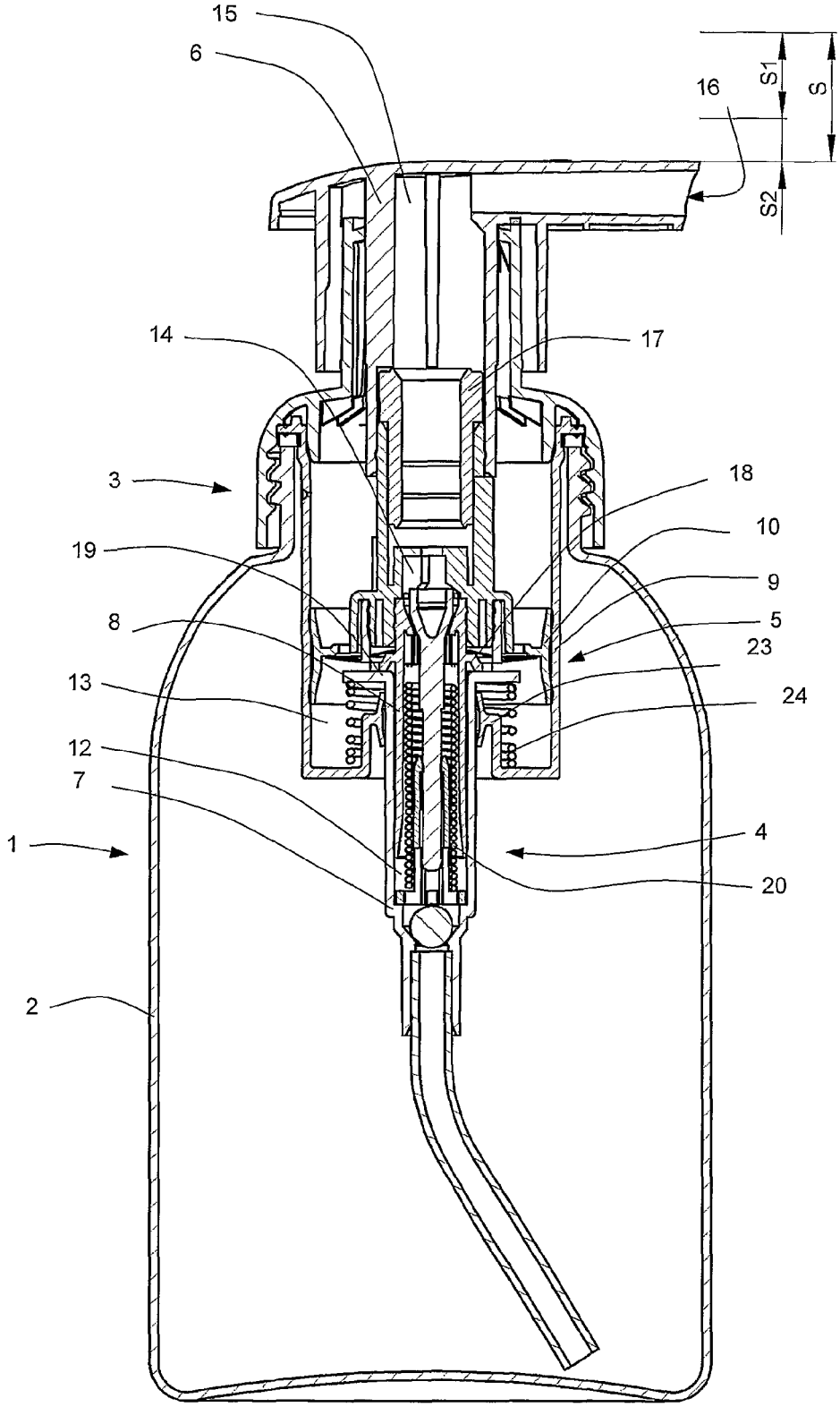

FIGS. 3*a*-3*c* show an alternative embodiment of the dispensing device according to the invention. In these figures, identical or similar parts are indicated by identical reference numerals. The dispensing device substantially operates in a similar manner to the dispensing devices described above with reference to the FIGS. 1*a*-1*c* and 2.

FIG. 3*a* shows the dispensing device in its rest position, i.e. at the start of the stroke. The liquid cylinder 7 is arranged in the air cylinder 9 so that it can be moved telescopically, with a seal 23 sealing the connection between the liquid cylinder 7 and the air cylinder 9. The liquid cylinder 7 is held in the uppermost position by means of a spring 24.

If the operating button is pushed downwards out of the illustrated rest position, the liquid piston 8 and the air piston 10 will move downwards, as a result of which the volumes in the liquid pump 4 and air pump 5, respectively, will decrease. As a result, the liquid pump 4 will deliver liquid and the air pump 5 will deliver air to the mixing chamber 14. There, foam will be formed which will flow through the dispensing passage 15 and the sieve element 17 in order to be dispensed through the dispensing opening 16.

As can be seen in FIG. 3*b*, at the end of the first part S1 of the stroke S, the cam element 18 will bear against the cam element 19, as a result of which the liquid piston 8 cannot be moved further into the liquid cylinder 7. If the operating button 6 is now pushed in further, the pistons 8 and 10 of the liquid pump 4 and air pump 5, respectively, will move further downwards during the second part S2 of the stroke S, with the liquid cylinder 7 moving concomitantly with the two pistons 8 and 10 as a result of the cam elements 18 and 19 bearing against each other. Consequently, the liquid pump 4 will not deliver any liquid to the mixing chamber 14, but the air pump will deliver air to the mixing chamber and subsequently to the dispensing passage 15, as a result of which the dispensing passage will at least partially be cleaned by blowing.

During the second part S2 of the stroke, the liquid cylinder 7 will move with respect to the air cylinder 9 and the spring 24 will be compressed. FIG. 3*c* shows the dispensing device at the end of the second part 32 of the stroke S. The seal 23 will seal the air pump chamber with respect to the interior of the container 2 even during the second part S2 of the stroke S.

It should be noted that the spring force of the spring 24 is preferably greater than the frictional force which occurs between the liquid piston 8 and the liquid cylinder 7 in order to ensure that the spring 24 can only be compressed during the second part of the stroke.

When the operating button 6 is released in this position, the dispensing device will return to the rest position as shown in FIG. 3*a* as a result of the spring force of the springs 20 and 24, and the liquid cylinder 7 will likewise return to its original position, as illustrated in FIG. 3*a*. It will be clear to those skilled in the art that in this embodiment, it is also possible to adjust the ratio between the first part S1 of the stroke and the second part S2 of the stroke on the basis of the distance between the cam elements 18 and 19 in the rest position as part of the entire stroke S. After all, this distance determines the first part S1 of the stroke.

Furthermore, this embodiment does not use a flexible connection between the air cylinder 9 and the liquid cylinder 7. The abovementioned effect of the relatively increasing volume of the air pump chamber resulting from the deformation of the flexible element does not occur in this case.

Figure 4A:
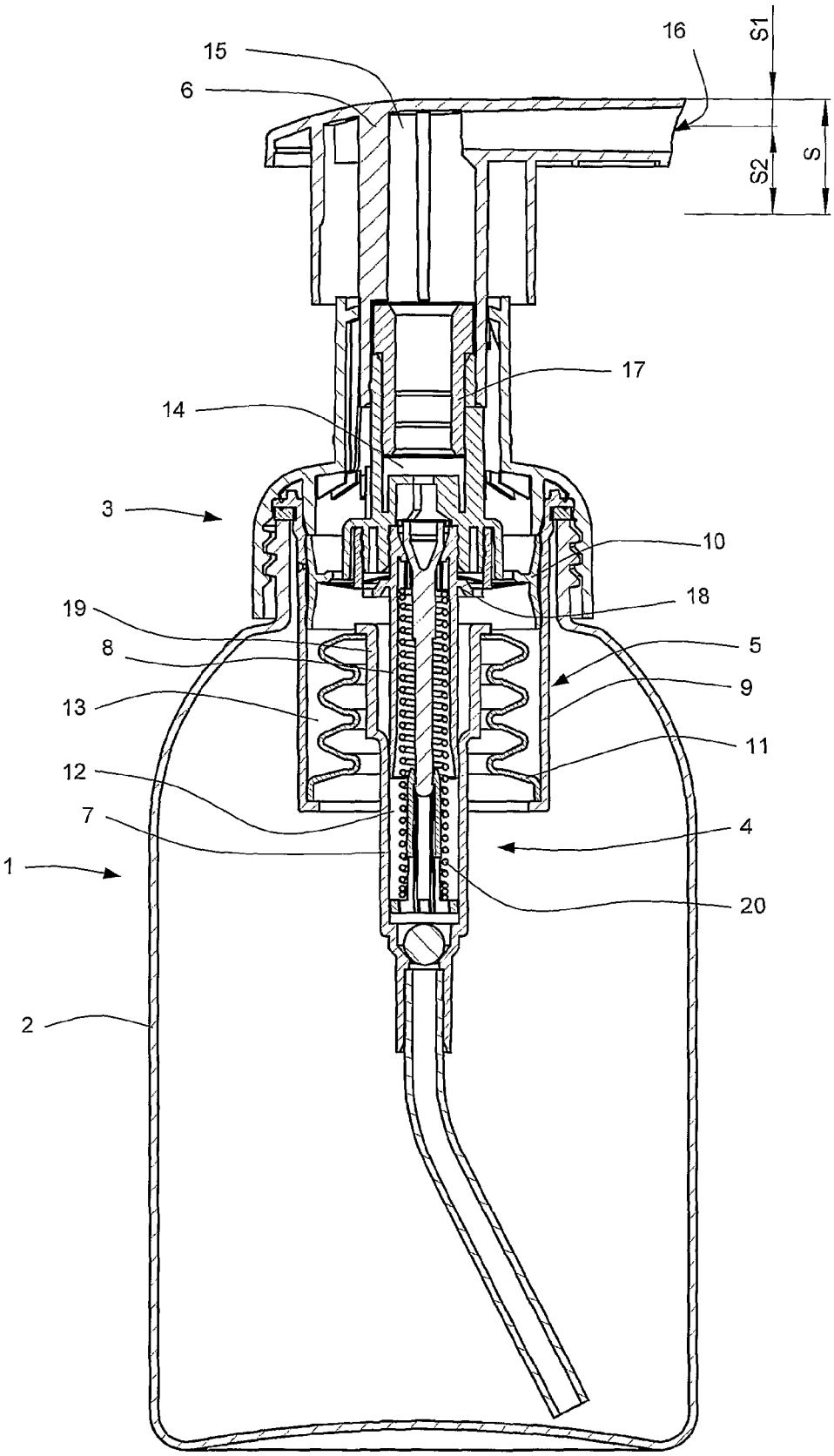
FIGS. 4*a*-4*c* show a third embodiment of a dispensing device according to the invention.
Figure 4B:
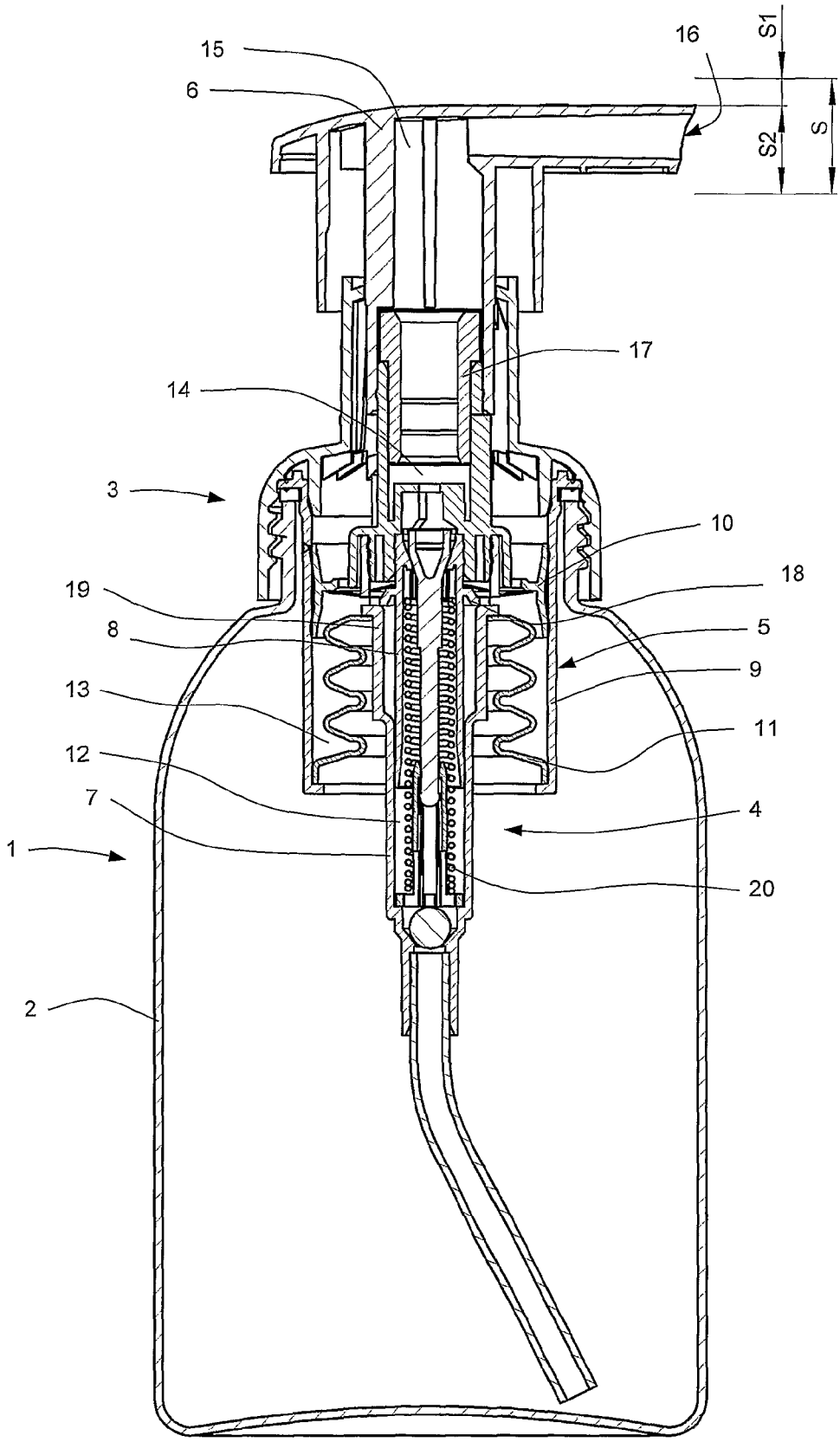
Figure 4C:
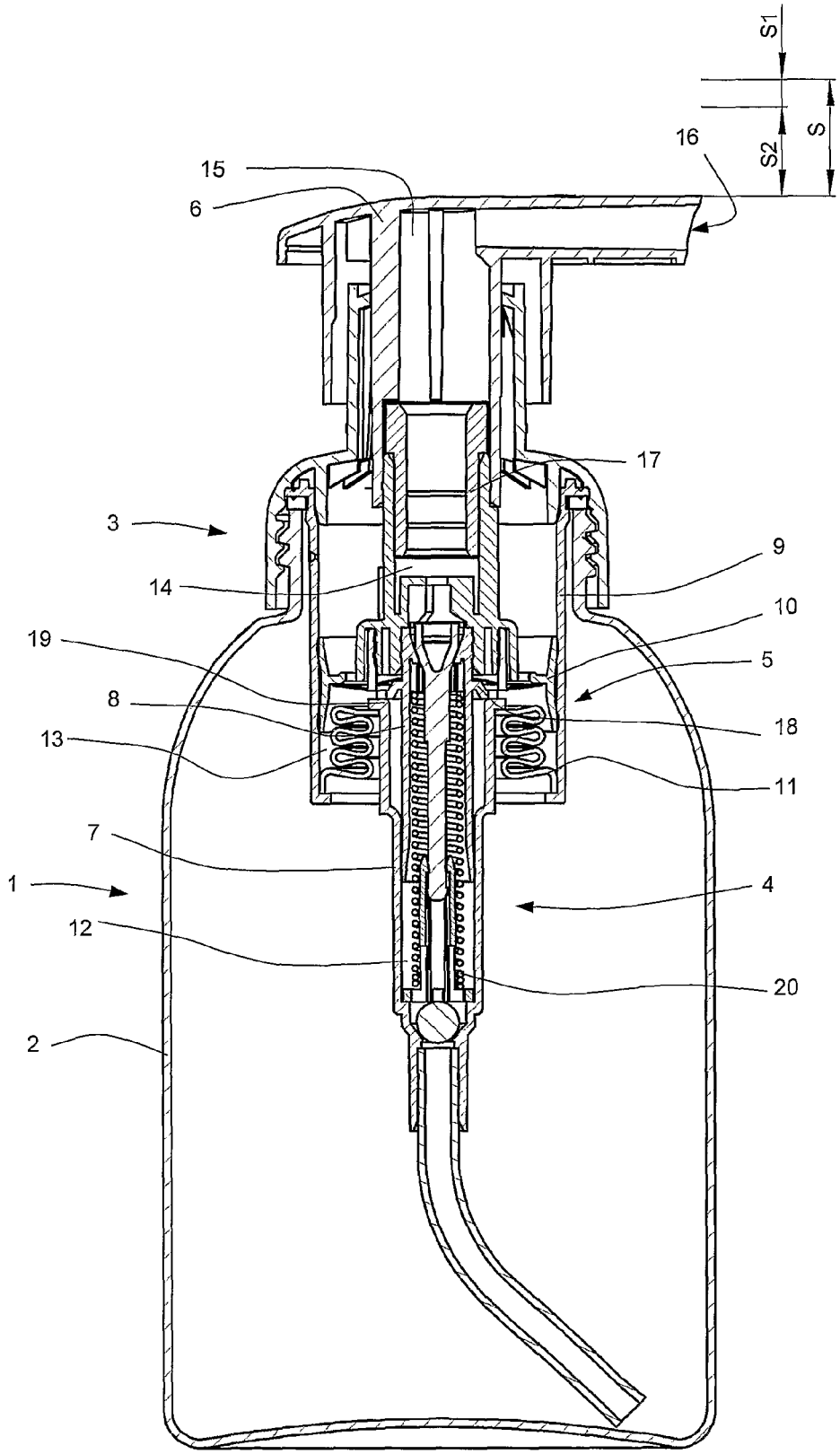

FIGS. 4*a*-4*c* show another alternative embodiment of the dispensing device according to the invention. In the embodiment of the FIGS. 4*a*-4*c*, identical or similar parts are denoted by identical reference numerals as well. The dispensing device operates substantially in a similar manner to the dispensing devices described above with reference to the FIGS. 1*a*-1*c*, 2 and 3*a*-3*c*.

In the embodiment according to FIGS. 4*a*-4*c*, the flexible element 11 of the embodiments of FIGS. 1*a*-1*c* and 2 is replaced by a bellows element 11. This bellows element 11 has the same function as the flexible element 11, namely providing a flexible, preferably elastic, connection between the air cylinder 9 and the liquid cylinder 7 in order to make it possible to move the liquid cylinder 7 with respect to the air cylinder 9 during the second part S2 of the stroke S.

However, the bellows element 11 does not have the effect of a relatively increasing air chamber of the air pump resulting from the deformation of the bellows element 11. During the second part S2 of the stroke, therefore, a relatively large amount of air will be pumped by the air pump, thus increasing the effect of cleaning by blowing.

FIG. 4*a* shows the dispensing device in the rest position. During the first part S1 of the stroke, the liquid pump 4 and the air pump 5 will deliver liquid and air, respectively, in order to form and dispense a foam. At the end of the first part of the stroke (see FIG. 4*b*), the cam elements 18 and 19 will come to lie against one another, as a result of which the liquid piston 8 cannot move further into the liquid cylinder 7.

When the operating button is pushed in further, the liquid cylinder 7 will move concomitantly with the operating button 6 and the pistons 8 and 10, with the result that no liquid will be delivered by the liquid pump. In this case, the bellows is pushed in (see for example FIG. 4*c* at the end of the stroke S). Air will however be delivered by the air pump 5, thus at least partially blowing the dispensing passage and the sieves of the sieve element clean.

After the operating button 6 is released, the dispensing device will return to the rest position, as illustrated in FIG. 4*a*.

In the embodiments according to FIGS. 1*a*-1*c*, 2, 3*a*-3*c* and 4*a*-4*c*, the transition between the first part of the stroke of the operating button 6 and the second part of the stroke is obtained by coupling the entire liquid pump to the operating button, so that the entire liquid pump moves concomitantly with the operating button during the second part of the stroke. This is a first way in which, according to the invention, the effect is achieved of forming foam during the first part of the stroke, while delivering only air to the mixing chamber during the second part of the stroke in order to blow the dispensing passage clean.

According to a second way, dividing the stroke into a first part and a second part is achieved, in which the liquid which is pumped by the liquid pump during the second part of the stroke is returned to the container. With this type of embodiment, it is therefore not necessary to interrupt the action of the liquid pump.

In one embodiment, it is, for example, possible to prevent more liquid flowing through the liquid piston by, for example, closing the open end of the liquid piston at the end of the first part of the stroke by means of a closing element, and by furthermore providing a pressure relief valve near the bottom end of the liquid cylinder, which will open as a result of the increasing pressure in the liquid cylinder resulting from the closure of the liquid piston. It is, for example, possible to design the liquid inlet valve as a pressure relief valve as well. Now, when the operating button is actuated, foam will be formed and delivered during the first part of the stroke. During the second part of the stroke, air will be delivered by the air pump to the mixing chamber, while the liquid which is being pumped as a result of the space in the pump chamber of the liquid pump decreasing will flow back to the liquid container.

Figure 5A:
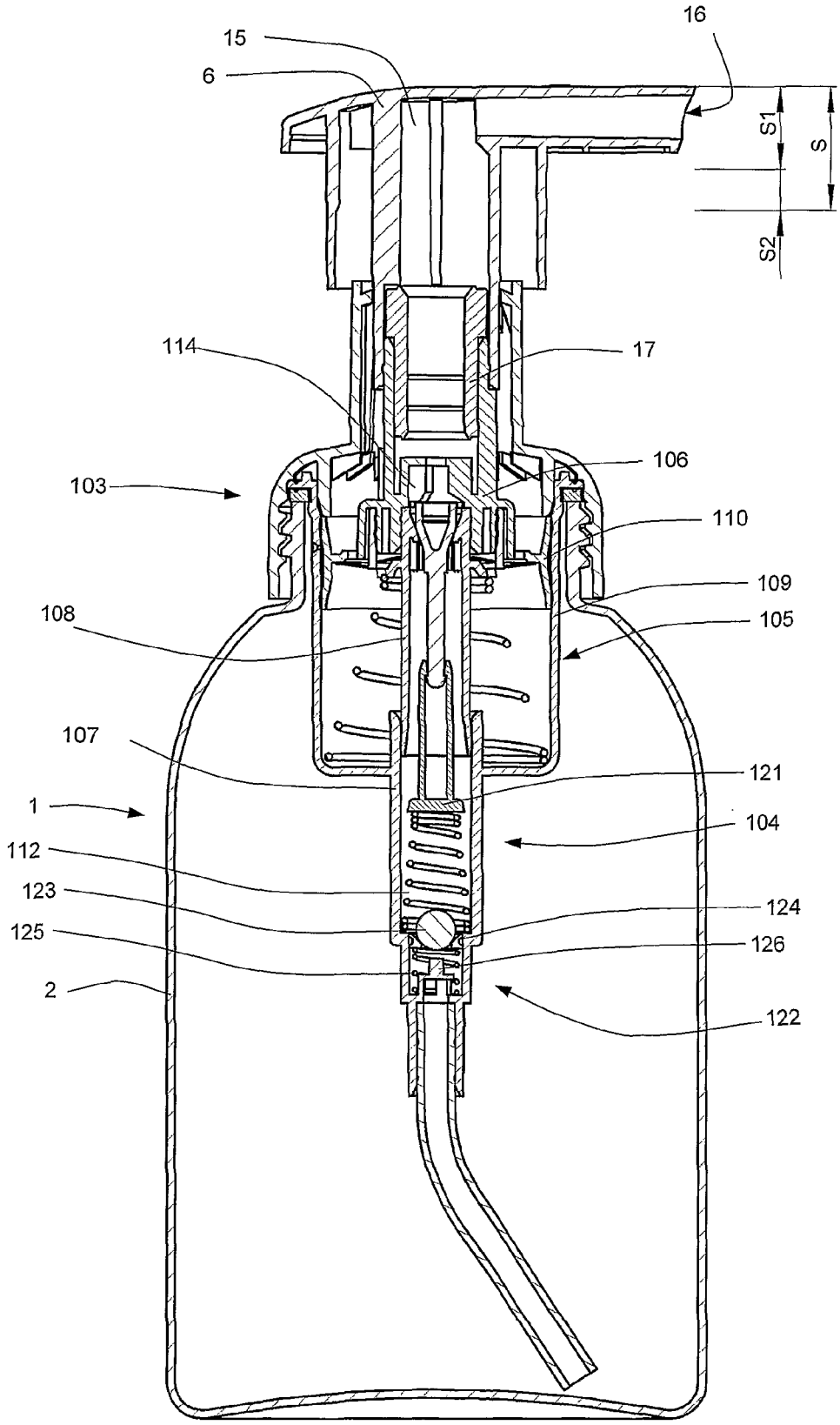
FIGS. 5*a*-5*c* show a third embodiment of a dispensing device according to the invention.
Figure 5B:
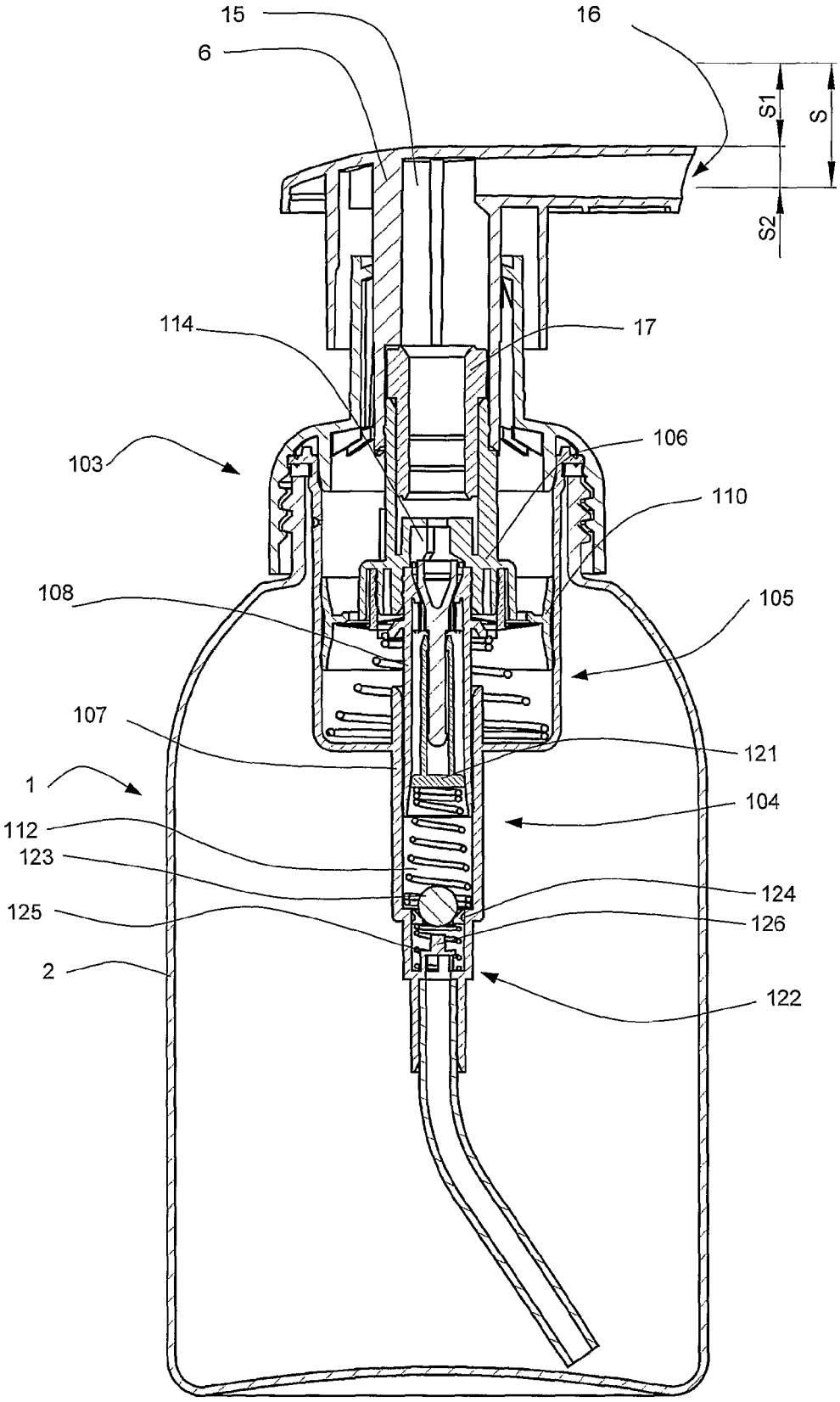
Figure 5C:
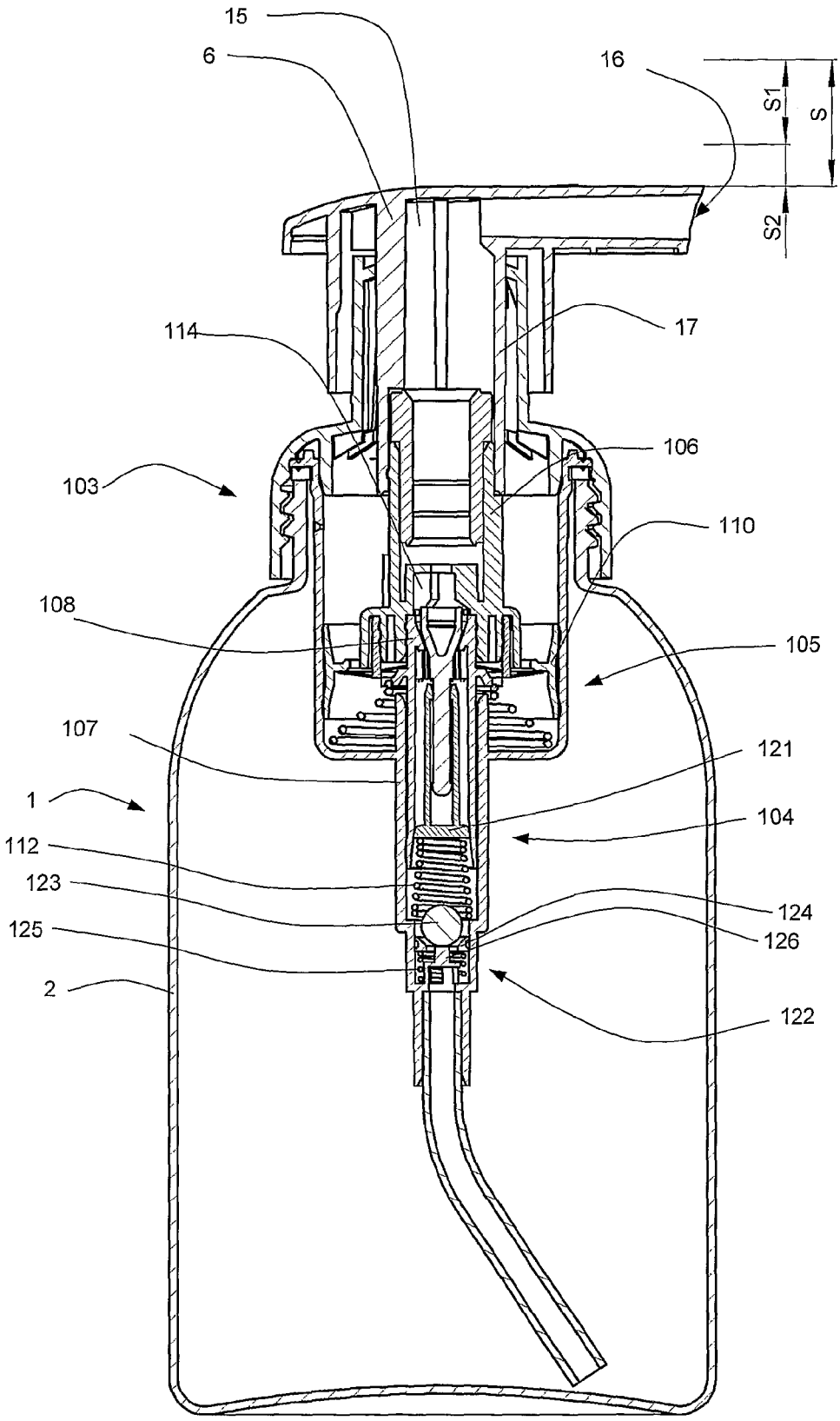

An example of an embodiment according to the second way is shown in FIGS. 5*a*-5*c*, which show a part of a pump assembly 103. The pump assembly 103 comprises a liquid pump 104 with a liquid cylinder 107 and a liquid piston 108 and an air pump 105 with an air cylinder 109 and an air piston 110. When the common operating button 106 is pushed downwards during the first part S1 of the stroke of the entire stroke S, the space in the liquid pump chamber 112 and the air pump chamber 113 will decrease as a result of the pistons 108, 110 moving downwards, whereby liquid and air in the mixing chamber 114 are combined to form a foam.

At the end of the first part S1 of the stroke, as illustrated in FIG. 5*b*, the closing element 121 will close the bottom of the liquid piston 108 so that no more liquid can flow through the piston to the mixing chamber 114. As the pressure in the interior of the liquid piston 108 will not increase further, no more liquid will therefore be delivered to the mixing chamber. Furthermore, the pressure in the liquid pump chamber 112 below the liquid piston 108 will increase further, the pressure relief valve 122 will open, as a result of which the liquid which is pumped by the decreasing part of the liquid pump chamber 112 below the liquid piston 108 during the second part S2 of the stroke is returned to the container.

During the second part S2 of the stroke, the air pump 105 will pump air to the mixing chamber 114 and the remaining part of the dispensing passage, with which air the latter can be blown clean. In FIG. 5*c*, the dispensing device is shown at the end of the stroke S.

The pressure relief valve 122, which also serves as inlet valve for the liquid, operates as follows. The sphere 123 is located on the seat 124. When the pressure in the liquid pump chamber decreases (during the upward stroke), the sphere 123 will be lifted off the seat 124 and liquid will be sucked into the liquid pump chamber.

During the downward stroke S, during the first part S1, the sphere 123 will be pushed onto the seat 124, as a result of which no liquid can flow through the valve 122 to the container. As the pressure in the liquid pump chamber below the piston will quickly increase during the second part of the stroke, the seat will be pushed down against the spring tension of spring 125, while the sphere 123 is retained by the cam element 126. As a result, the seat 124 will be detached from the sphere 123, making it possible for liquid to flow back to the container.

According to a third way of dividing the stroke into a first part, during which foam is formed, and a second part, during which only air is delivered to the dispensing passage, the dispensing device is designed in such a manner that, at the end of the first part of the stroke, the operating element is uncoupled from the liquid pump so that the latter is not actuated anymore during the second part of the stroke.

Figure 6A:
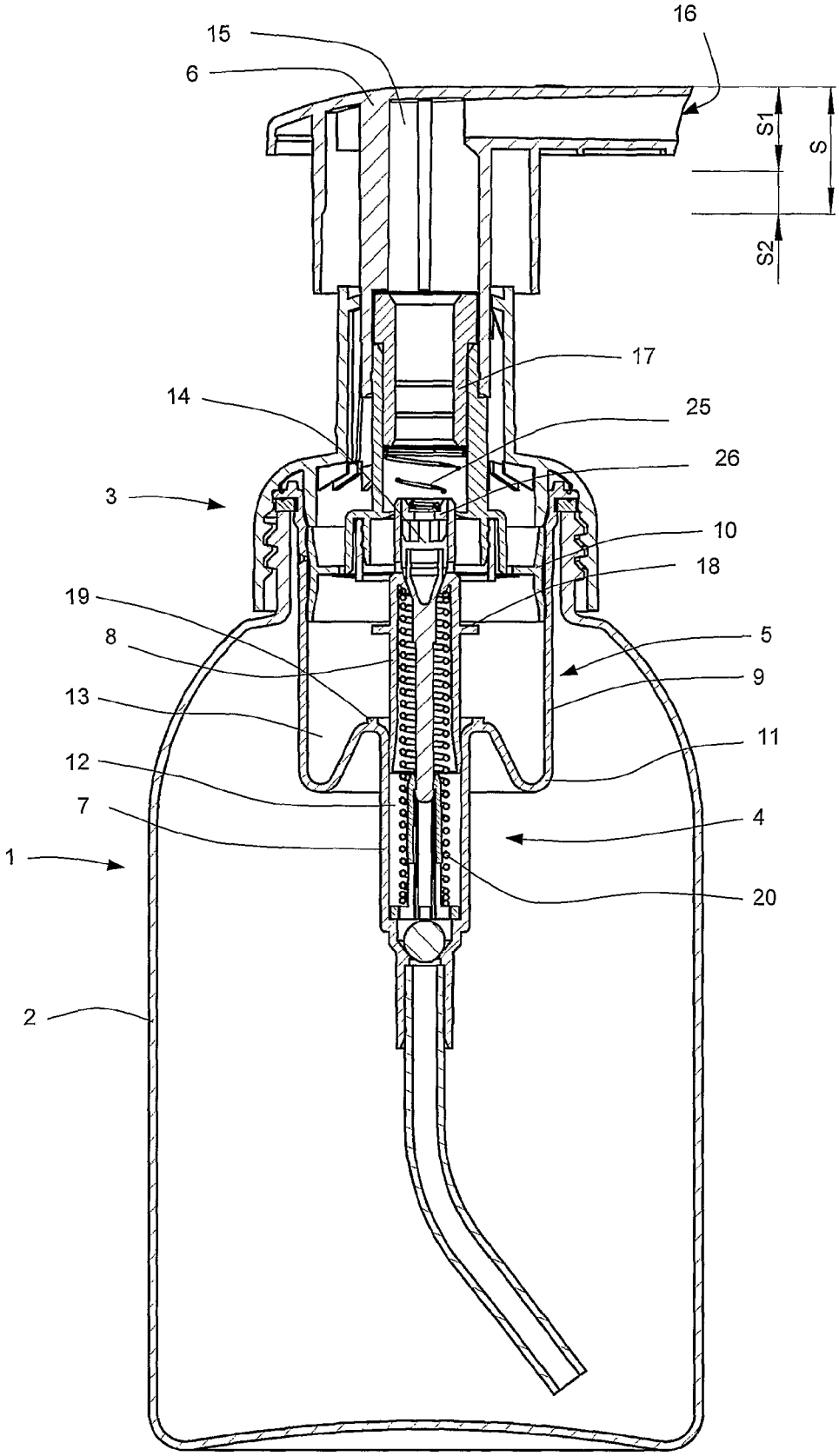
FIGS. 6*a*-6*c* show a third embodiment of a dispensing device according to the invention.
Figure 6B:
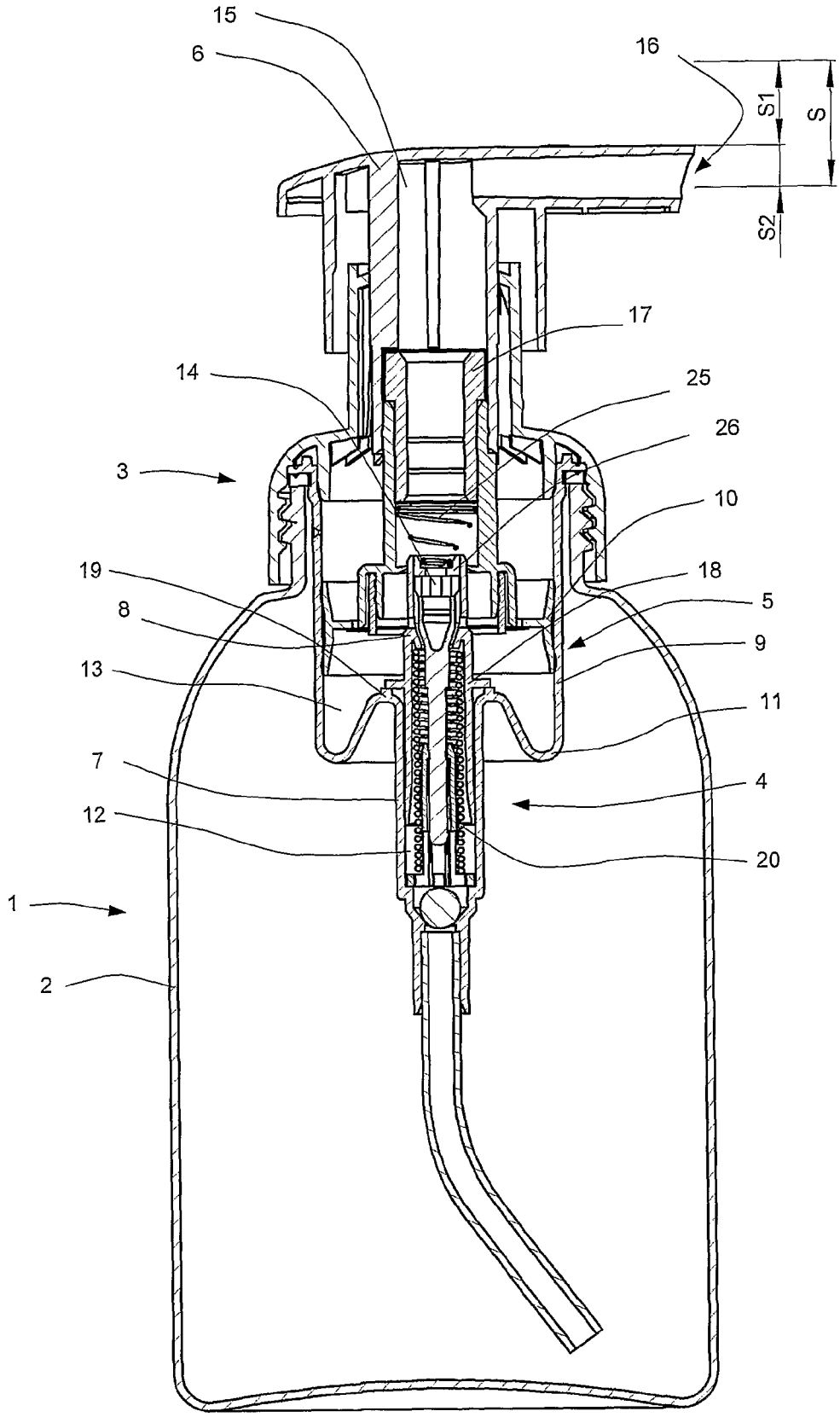
Figure 6C:
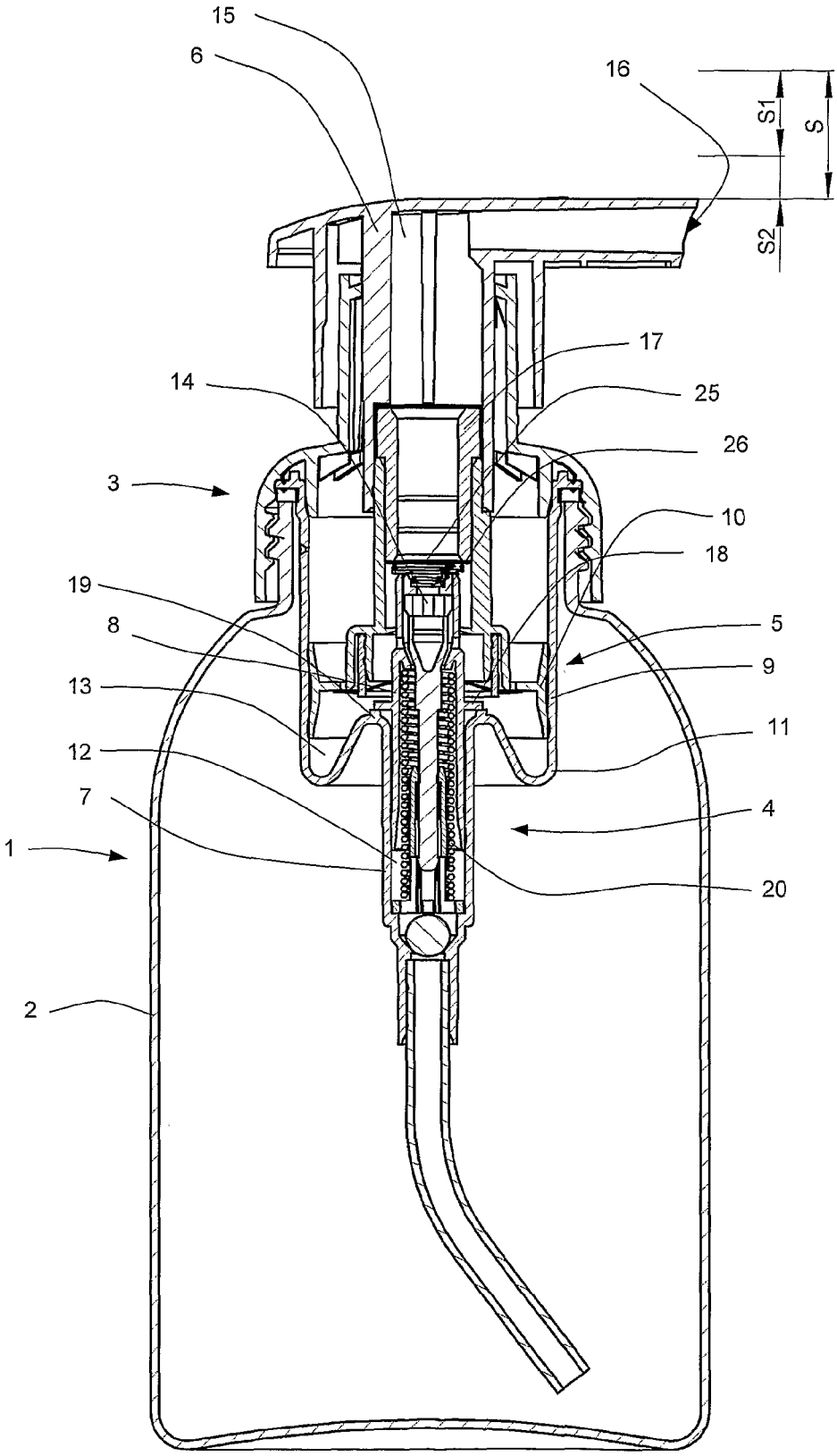

One embodiment according to this third way is shown in FIGS. 6*a*-6*c*. The construction of the dispensing device according to FIGS. 6*a*-6*c* is substantially similar to the dispensing devices described above. Therefore, identical parts are denoted by identical reference numerals. The points in which the dispensing device of FIG. 4 differs from the dispensing device according to FIGS. 1*a*-1*c* will be discussed below.

During the first part S1 of the stroke of the entire stroke S of the operating button, the action of the dispensing device 1 of FIG. 4 is substantially identical to the action of the above-described dispensing device according to the FIGS. 1*a*-1*c*. During operation of the operating button 6, the liquid pump 4 and the air pump 5 are actuated in order to deliver liquid and air to the mixing chamber 14, where a foam is formed which is dispensed through the dispensing passage 15 at the dispensing opening 16. In the dispensing passage 15, the foam is smoothed and homogenized by means of the sieves of the sieve element 17.

At the end of the first part S1 of the stroke, the cam element 18 of the liquid piston 8 will come to lie against the cam element 19 of the liquid cylinder 7, as is shown in FIG. 6*b*. When the operating button 6 is pushed down further, the liquid piston 8 will therefore no longer be able to move with respect to the liquid cylinder 7. However, in the embodiment according to FIG. 3, the connecting element 11 which connects the liquid cylinder 7 to the air cylinder 9 is of rigid design, so that it is not possible for the entire liquid pump 4 to move concomitantly with the operating button 6 during the second part of the stroke. In FIG. 6*c*, the dispensing device is shown at the end of the second part S2 of the stroke.

In contrast thereto, a spring 25 is positioned between the operating button 6 and the liquid piston 8. A rest 26 is provided in order to enable the installation of the spring 25. However, the air piston 10 is connected directly to the operating button 6. The spring 21 can thus be compressed during the second part S2 of the stroke, so that the liquid cylinder 7 and the liquid piston 8 which are coupled to one another by means of the cam elements 18 and 19 do not have to move with respect to one another.

The air piston 10 will thus move with respect to the air cylinder 9 during the second part of the stroke and thus pump air to the dispensing passage in order to blow the latter clean. The liquid piston 8 will then not move with respect to the liquid cylinder 7, so that no liquid is delivered during the second part of the stroke.

Figure 7:
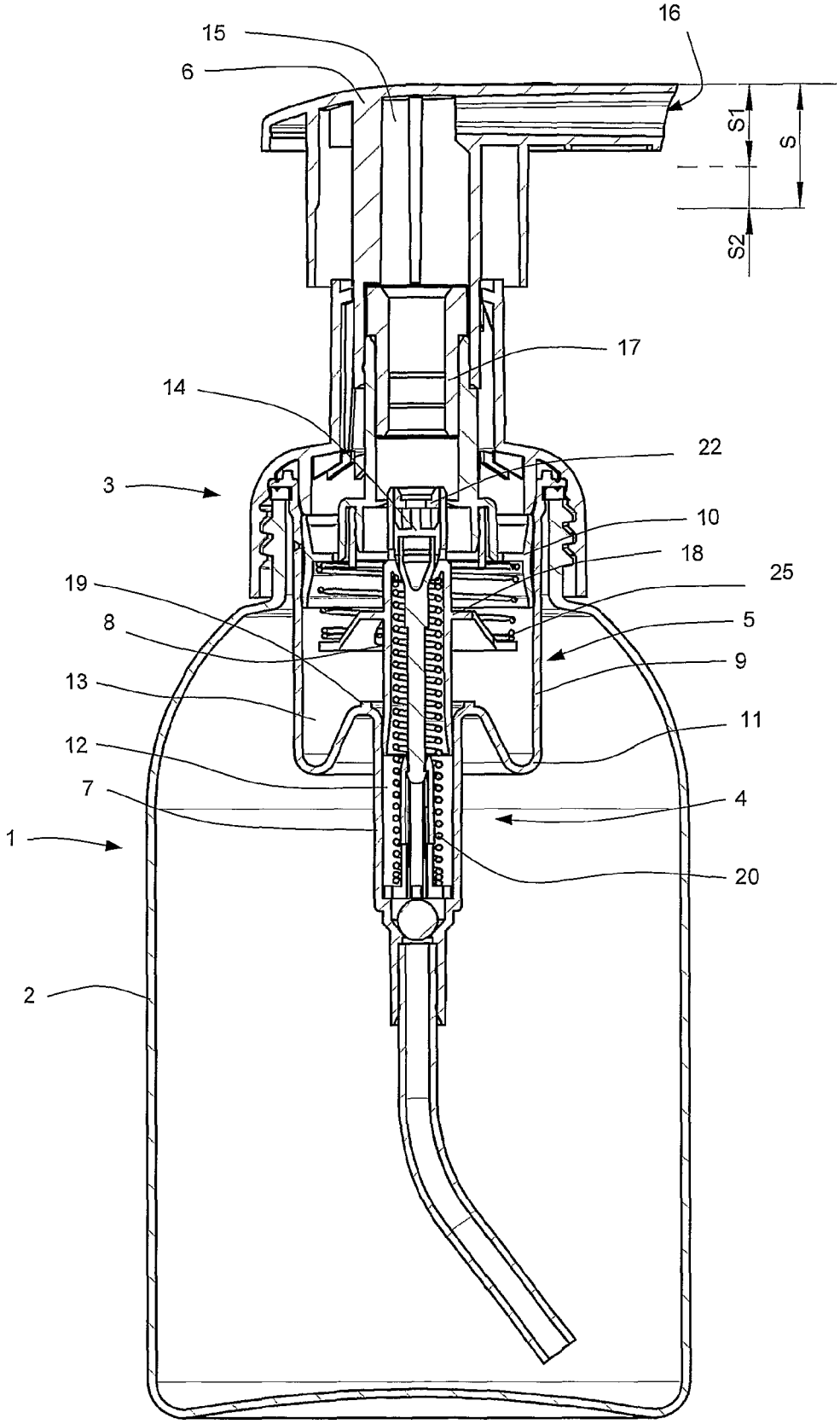
FIG. 7 shows a fourth embodiment of a dispensing device according to the invention.

FIG. 7 shows an alternative location for the spring 25. The spring 25 is in this case positioned between the air piston 10 and the cam element 19, so that, in this case as well, the air piston 10 can move further downwards as a result of the spring 25 being compressed, while the liquid piston is coupled to the liquid cylinder 8 so that these do not move further with respect to one another during the second part of the stroke.

As an alternative to the spring element 25, it is also possible to use a bellows-like part or a part which is flexible in another way and which can be pushed in during the second part of the stroke of the operating button. It is also possible to provide the part 25 to be pushed in the form of a part of the liquid piston 8 or the operating button, although the space in pump chamber 12 of the liquid pump 4 must be prevented from becoming smaller.

What is claimed is:

1. A foam-dispensing device comprising:

a pump assembly, which pump assembly comprises a liquid pump and an air pump, which can be actuated by means of a common operating element, which can be moved with respect to a fixed part of the pump assembly, for delivering a liquid and air, respectively, to a common dispensing passage where the liquid and the air are combined to form a foam, the operating element being able to perform a stroke in order to actuate the liquid pump and the air pump, wherein the foam-dispensing device is designed to deliver, during a first part of the stroke, both liquid from the liquid pump and air from the air pump to the dispensing passage in order to form a foam, and to deliver, during a second part of the stroke, only air from the air pump to the dispensing passage, and wherein the liquid pump is movably connected to the fixed part of the pump assembly and wherein the entire liquid pump is coupled to the operating element at the end of the first part of the stroke of the operating element to move the entire liquid pump concomitantly with the operating element during the second part of the stroke of the operating element.

2. The foam-dispensing device of claim 1, wherein the liquid pump comprises a first pump part and a second pump part, which first pump part and second pump part at least partially delimit a pump chamber, wherein the first pump part is connected to the common operating element and wherein the second pump part is connected to the fixed part of the pump assembly, in which the first pump part is movable with respect to the second pump part during the first part of the stroke, and in which the foam-dispensing device comprises a coupling device which couples the first pump part to the second pump part at the end of the first part of the stroke in such a manner that, during the second part of the stroke, the first and the second pump part are not movable with respect to one another.

3. The foam-dispensing device of claim 2, wherein the coupling device comprises a first cam element provided on the first pump part and a second cam element on the second pump part, which first and second cam element bear against one another at the end of the first part of the stroke.

4. The foam-dispensing device of claim 2, wherein the second pump part is connected to the fixed part of the pump assembly via a flexible connection in such a manner that, during the second part of the stroke when the flexible connection deforms, the entire liquid pump is coupled to the operating element.

5. The foam-dispensing device of claim 2, wherein the first pump part is a liquid piston and the second pump part is a liquid cylinder, and in which the fixed part of the pump assembly is formed by an air cylinder of the air pump.

6. The foam-dispensing device of claim 5, wherein the liquid cylinder and the air cylinder are connected by means of a flexible part in such a manner that they can move with respect to one another.

7. The foam-dispensing device of claim 5, wherein the liquid cylinder is telescopically movable with respect to the air cylinder.

8. The foam-dispensing device of claim 5, wherein the liquid cylinder is arranged concentrically with respect to the air cylinder.

9. The foam-dispensing device of claim 7, wherein the liquid cylinder can slide and move telescopically in a sealing connection of the air cylinder.

10. The foam-dispensing device of claim 5, wherein the dispensing device comprises a spring element, which spring element places the liquid cylinder under prestress into an initial rest position with respect to the air cylinder.

11. A method for dispensing a foam using a foam-dispensing device comprising a pump assembly, which pump assembly comprises a liquid pump and an air pump which can be actuated by means of a common operating element in order to deliver a liquid and air, respectively, to a common dispensing passage where the liquid and the air are combined to form a foam, which operating element can perform a stroke in order to actuate the liquid pump and the air pump, wherein both the liquid pump and the air pump are actuated during a first part of the stroke of the operating element in order to dispense liquid and air, respectively, in order to form a foam, wherein the liquid pump is movably connected to the fixed part of the pump assembly and wherein the entire liquid pump is coupled to the operating element at the end of the first part of the stroke of the operating element to move the entire liquid pump concomitantly with the operating element during a second part of the stroke of the operating element and only the air pump is actuated during the second part of the stroke of the operating element in order to deliver air to at least a part of the common dispensing passage.

* * * * *